United States Patent [19]

Revankar et al.

[11] Patent Number: 5,027,878

[45] Date of Patent: Jul. 2, 1991

[54] METHOD OF IMPREGNATION OF IRON WITH A WEAR RESISTANT MATERIAL

[75] Inventors: Gopal S. Revankar, Moline; Daniel L. DeRoo, Colona; John J. Maberry, Silvis; David P. Jones, East Moline, all of Ill.

[73] Assignee: Deere & Company, Moline, Ill.

[21] Appl. No.: 417,306

[22] Filed: Oct. 5, 1989

[51] Int. Cl.[5] ..... B22D 19/00; B22C 9/02

[52] U.S. Cl. ..... 164/98; 164/34

[58] Field of Search ..... 164/34, 35, 36, 45, 164/98

[56] References Cited

U.S. PATENT DOCUMENTS

| | | | |
|---|---|---|---|
| 1,072,026 | 9/1913 | Morris | 164/97 |
| 1,403,005 | 1/1922 | Bowers | 164/97 |
| 1,893,539 | 1/1933 | Edmondson et al. | 164/75 |
| 1,893,540 | 1/1933 | Edmondson et al. | 164/75 |
| 1,978,319 | 10/1934 | Mowery | 164/97 |
| 2,260,593 | 10/1941 | Wittlinger et al. | 164/97 |
| 3,639,507 | 2/1972 | Uram | 164/36 |
| 4,093,018 | 6/1978 | Trumbauer | 164/34 |
| 4,119,459 | 10/1978 | Ekemar et al. | 75/243 |
| 4,462,453 | 7/1984 | Trumbauer | 164/32 |
| 4,481,999 | 11/1984 | Duchane et al. | 164/44 |
| 4,691,754 | 9/1987 | Trumbauer et al. | 164/9 |
| 4,790,367 | 12/1988 | Moll et al. | 164/34 |
| 4,808,360 | 2/1989 | Natori et al. | 164/36 |

FOREIGN PATENT DOCUMENTS

| | | | |
|---|---|---|---|
| 74-007299 | 2/1974 | Japan | 164/98 |
| 1-0022462 | 1/1989 | Japan | 164/98 |

OTHER PUBLICATIONS

"Application of Cast-On Ferrochrome-Based Hard Surfacings to Polystyrene Pattern Castings", by J. S. Hansen et al.

"Cast In-Place Hard Surfacing"—Physical Metallurgy Research Laboratories, by K. G. Davis and J. G. Magny.

*Primary Examiner*—Kurt Rowan

*Assistant Examiner*—Rex E. Pelto

*Attorney, Agent, or Firm*—Burns, Doane, Swecker & Mathis

[57] ABSTRACT

A method for impregnating an iron product with a hard wear-resistant material surface layer comprises providing a destructible pattern of the desired iron product and applying a paste which comprises a powder of the wear-resistant material and a binder comprising a solution of polyvinyl alcohol onto a portion of the surface of the pattern. The pattern is then coated with a refractory layer by applying a suitable aqueous slurry. A mold is made using the pattern and then an iron melt is cast into the mold thereby forming an iron product having a cast in-place wear-resistant material surface layer. In other embodiments, the method includes the formation of a cavity in the pattern where the binder and particles are introduced into the cavity. In addition, a sheet comprising the binder and particles can be formed, which sheet is then attached to the pattern.

50 Claims, 4 Drawing Sheets

FIG. 1A
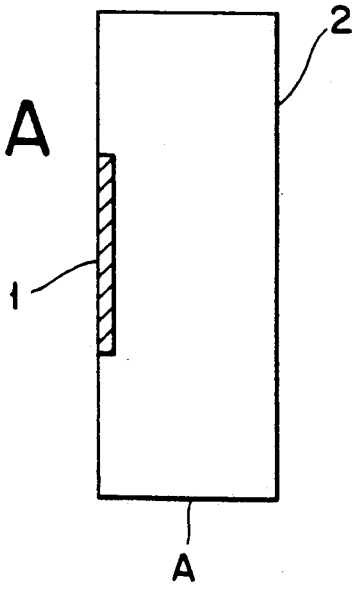
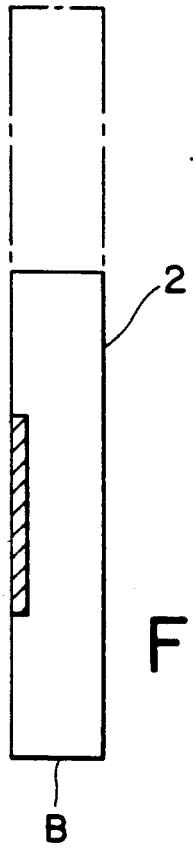
FIG. 1B

METHOD OF IMPREGNATION OF IRON WITH A WEAR RESISTANT MATERIAL

BACKGROUND OF THE INVENTION

The present invention relates to a process for the impregnation of an iron product with a surface comprising a hard wear-resistant material.

A wide variety of techniques are known for the impregnation of iron with a hard wear-resistant surface. Such techniques include flame spray coating and plasma spray coating. However, each of these spray coating techniques suffer from problems associated with the spalling of surface layers during the coating process and during service as well as the particularly large expense associated with the use of these techniques.

Cast-In-Carbides are also known in which carbide particulates are placed within a mold and molten iron is then cast. See, for example, the discussion within U.S. Pat. No. 4,119,459 to Ekemar et al. It is difficult, however, with such castings to accurately maintain the carbide particulates in the desired location.

In addition, certain cast-on hard surfacing techniques for use with polystyrene patterns are also known in the art. See, for example, the discussion in Hansen et al, "Application of Cast-On Ferrochrome-Based Hard Surfacings to Polystyrene Pattern Castings," Bureau of Mines Report of Investigations 8942, U.S. Department of the Interior, 1985.

With the process discussed in Hansen et al, a paste comprising a binder and the desired hard material, such as tungsten carbide powder, is applied to those surfaces of a polystyrene pattern which correspond to wear-prone surfaces of the resulting casting. A refractory coating is then applied on the entire pattern prior to casting the metal.

However, this process suffers from problems associated with the low reliability of the bond formed between the wear resistant layer, e.g., tungsten carbide, and the foam pattern which is predominantly caused by the failure of the nearly dry paste to wet the foam surface sufficiently. Because of this failure, the iron does not penetrate the layer before the iron solidifies and, thus, instead of impregnating the iron, the carbide spalls off the product.

This process is also complex and inefficient and thus cannot be effectively employed for large scale production.

Furthermore, the use of non-aqueous binders in this process requires the subsequent use of non-aqueous refractory slurries which are applied to the pattern to prevent molten metal contact with the sand and thus to improve the machinability and surface finish of the casting. However, the use of non-aqueous refractory slurries introduces a wide variety of safety hazards and thus are completely undesirable.

Accordingly, the need still exists for a method of impregnating iron surfaces with a hard wear-resistant material which can overcome, obviate, or alleviate the problems of the prior art.

It is an object of the present invention to provide a method for impregnating iron surfaces which provides a strong bond between the wear-resistant material and the iron.

Further, it is an object of the present invention to provide a method in which an aqueous slurry can be employed.

These and further objects will become apparent from the specifications and claims which follows.

SUMMARY OF THE INVENTION

In one aspect of the present invention, there is disclosed a method for impregnating an iron product with a hard wear-resistant material surface layer comprising (a) providing a destructible pattern of the desired iron product;

(b) applying a paste comprising a powder of the wear-resistant material and a binder comprising a solution of polyvinyl alcohol onto at least a portion of the surface of the said pattern;

(c) making a mold using the said pattern;

(d) casting an iron melt into said mold thereby forming an iron product having a wear-resistant material surface layer.

In another aspect of the present invention, a method of impregnating an iron product with a hard wear-resistant material surface layer comprising (a) providing a destructible pattern for a desired iron metal product;

(b) forming at least one groove or depression in the surface of the pattern;

(c) introducing an aqueous binder into said at least one groove or depression;

(d) introducing a wear-resistant material into the said at least one groove or depression;

(e) making a mold using said pattern;

(f) casting an iron melt into said mold thereby forming an iron product having a hard wear-resistant material surface layer.

In still another aspect of the present invention, a method for impregnating an iron product with a hard wear-resistant material surface layer comprising (a) providing a destructible pattern of a desired iron product;

(b) preparing a formable sheet comprising the hard wear-resistant material and a binder;

(c) forming the formable sheet into a desired shape and size;

(d) attaching the formed sheet onto at least a portion of the pattern;

(e) making a mold using the pattern;

(f) casting an iron melt into said mold thereby forming an iron product having a hard wear-resistant surface layer.

In each of these embodiments, the pattern can be coated with an aqueous ceramic slurry prior to making the mold using the pattern.

In addition, there is provided the product of each of these processes.

BRIEF DESCRIPTION OF THE DRAWINGS

FIG. 1 illustrates a technique for increasing the duration of liquid metal/carbide contact.

DETAILED DESCRIPTION OF THE PREFERRED EMBODIMENTS

Figure 2:
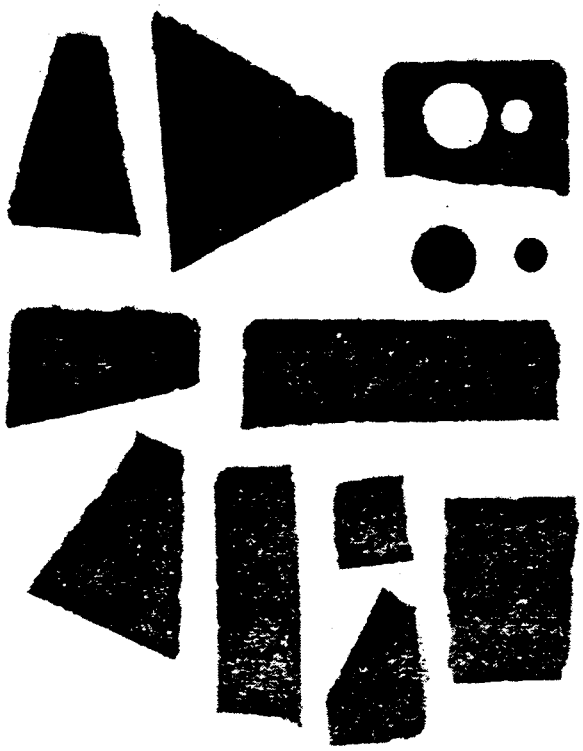
FIGS. 2–6 are photographs illustrating various aspects of the present invention.

The present invention can be employed for the casting of any type of iron which is known in the art. However, cast iron and, in particular, ductile or gray iron are preferred.

With regard to the destructible pattern which is employed in the present invention, any material suitable for making the pattern can be employed. Expanded polystyrene, (EPS), and polymethyl-methacrylate, (PMMA), are preferably used. Because PMMA is less susceptible to either the formation of undesirable carbon defects within the casting or problems associated with spalling, it is most preferred.

In the present invention, the hard wear-resistant material is preferably used in the form of particles of a size of from about 15 microns to about 1.5 mm or more. The particle size is preferably from about 140 to about 548 microns (30 mesh size), most preferably from about 140 to about 149 microns (100 mesh size). In particular, because carbon defects are more easily formed when powders of a finer size, i.e., 200 mesh size (74 microns) or finer, are employed, it is preferred, but not critical, to employ sizes larger then this within the present invention.

The particles are also generally spherical for ease of flow and other practical considerations, although the shape is not critical to the present invention.

As to the choice of the hard wear-resistant material, the present invention can effectively employ any of the hard phases which are traditionally employed with the art, such as tungsten carbide, chromium carbide, and the like, or mixtures thereof. It had been found that the use of a wear-resistant material which has adequate wettability with respect to the iron casting employed is effective in decreasing the spalling problem associated with prior art castings. Thus, where ductile iron is employed as the metal to be cast, spheroidal or angular tungsten carbide, or a eutectic mixture of WC and $W_2C$ or other carbides such as chromium carbide are preferred while alumina is least preferred.

Furthermore, the wettability of tungsten carbide is found to be increased when the carbon content of the powder is less than stoichiometric (i.e., less than 6.5 weight percent for WC). Thus, the use of sub-stoichiometric carbon, spheroidal tungsten carbide powder having a carbon content of about 4% as well as a eutectic mixture of $W_2C$ and WC (commercially available under the generic term "crushed carbide") are most preferably employed with ductile iron in the present invention.

A solution of polyvinyl alcohol (PVA) is preferred as the binder because PVA is greatly soluble in water and does not require the use of a flammable liquid such as alcohol. Also, PVA evaporates quickly without leaving a carbon residue on the particles, thus enhancing the wetting action of the molten metal which results in an easy flow of the metal into the carbide particle network. Preferably, the binder comprises a solution of PVA and water having a concentration greater than 5% by weight, more preferably from about 9.5 to about 10.5 percent by weight of PVA.

The process of the present invention is used to provide a casting with the wear-resistant material at a particular place (or places) of the casting utilizing a destructible pattern of the desired casting. A destructible pattern of a particular shape and size (which is dependent upon the ultimate cast product desired) may be produced by any known method. In particular, certain efficacious methods for forming destructible patterns are illustrated within U.S. Pat. Nos. 4,093,018 and 4,462,453 to Trumbauer and U.S. Pat. No. 4,691,754 to Trumbauer et al.

A paste of the wear-resistant particles and the PVA-water binder solution is made by mixing the particles into the binder solution. The paste is then applied, for example, by brushing or the like, to the surface of the pattern at those points where the impregnation of the wear-resistant material into the iron surface is desired with additional PVA-water binder solution, if required.

After the hard wear-resistant particle-containing paste is applied to the desired local areas of the destructible pattern, and the paste is thoroughly dried at room temperature or, preferably, at higher temperatures up to a maximum of about 60° C., for several hours, a ceramic slurry coating can be applied onto the entire pattern, as is known within the art, to prevent molten metal contact with the sand mold, thus improving both the machinability and surface finish of the desired product.

In the past, attempts to employ aqueous ceramic slurries at this stage of the process were ineffective because the use of aqueous slurries on a foam pattern containing a carbide and binder layer thereon caused the undesirable dissolution of the binder into the aqueous slurry and the consequent stripping off of the carbide layer. However, the use of a PVA binder according to the present invention effectively eliminates this problem and thus allows for the use of aqueous ceramic slurries if some simple precautions, as discussed above, are taken. Moreover, the use of aqueous slurries within the present invention is also effective in overcoming the safety hazards associated with traditional non-aqueous slurries.

Several techniques can be employed for applying the ceramic slurry to the patterns, e.g., painting the surface with a brush or airspray of the slurry. However, direct dipping of the pattern into the slurry is considered the most efficient within a mass production environment and thus is preferably employed within the present invention.

It has also been found that the problems associated with dissolution of the binder into the aqueous solution can be further minimized by the rapid removal of the pattern from the slurry with the subsequent shaking away of the excess slurry from the pattern and immediately transferring the pattern to a hot air oven, which is preferably held at about 50° C. for several hours, for thorough drying.

At this point the pattern is used to form a mold and subjected to casting of the metal through any of the casting techniques traditionally employed in the art. See, for example, the discussion of sand mold casting presented within Hansen et al.

In casting of the metal, it has been found that an increase in the duration of the time the wear-resistant material is in contact with the molten metal decreases the tendency for spalling of the material. One method for increasing the duration of material/liquid metal contact is the use of a superheated liquid metal in the process. By this method, the liquid metal is superheated to a temperature in excess of the liquidus temperature. To ensure proper superheating, the metal is heated preferably to about 250° C. to 320° C. in excess of the liquidus temperature. This allows for more time for metal solidification and hence for metal penetration into carbides and the formation of a non-spalling composite layer.

Another method of increasing the duration of liquid metal/carbide contact can be found in increasing the casting volume and, thus, the casting volume to carbide area ratio of the casting. In other words, the casting volume is chosen such that the ratio of the casting volume to the area of wear-resistant material is sufficient to provide an increased duration of liquid metal/wear resistant material contact during casting. This concept is further illustrated by FIG. 1.

As shown in FIG. 1, the probability of spalling for wear resistant layer, 1, is much less in casting A than in casting B because the larger volume of metal, 2, in A requires a longer period of time to freeze. Thus, when casting thin sections, i.e., B, it has been found that the extending of the casting beyond the required height (as illustrated by the dashed lines) increases the carbide/liquid metal contact and decreases the probability of spalling.

In an alternate embodiment of the present invention, at least one cavity or depression can be formed in the foam pattern prior to the application of the hard wear-resistant particle paste. These cavities can be machined in the foam pattern by any traditional method such as milling, drilling or the like. The cavity or depression preferably has a depth of about 0.5 mm to about 3.00 mm, depending on the component or wear life requirement.

The cavity or depression can then be filled with the hard wear-resistant particle-containing paste to insure their proper location within the resulting casting.

Instead of introducing the paste into the cavity, only the binder solution can first be introduced into the cavity thereby insuring a thorough wetting of the foam surface. The particulate wear-resistant material can then be poured into the cavity and allowed to settle and closely conform to the cavity. Excess PVA-water binder can then be wiped off using a suitable absorbent material. If desired, the wear-resistant layer can be allowed to dry, e.g., at room temperature, but, preferably at an elevated temperature, most preferably about 60° C., prior to coating with the ceramic slurry.

The pattern is then coated with the slurry and cast with the metal in the same manner as that described above.

In yet another embodiment of the present invention, sheets formed from a powder of wear-resistant material and a binder are prepared using molds and then divided into the required shapes.

First, the particulate wear-resistant material and PVA-water binder are mixed within a mold and spread evenly. Excess binder can be removed through the use of a suitable absorbent material. The sheet is then allowed to dry under suitable conditions in order to partially set the binder sheet. In a preferred embodiment, the sheet is dried for a period of time ranging from about 45 minutes to about 75 minutes with 60 minutes being most preferred in a suitable environment, such as in an oven held at about 60° C. to about 65° C., with 60° C. being most preferred. This allows the sheet to be strong enough for handling and subsequent cutting into desired pieces.

After the sheet is cut into pieces of a desired shape and size, or holes are drilled through these sheets as illustrated within FIG. 2, the cut pieces are dried under conditions which allow for either immediate use or storage for future applications. In a preferred embodiment, this drying can occur at a temperature ranging from about 60° C. to about 65° C., with 60° C. being particularly preferred, for about 8 hours to 24 hours, with 24 hours being particularly preferred.

It is also preferred that a fully dried sheet is softened prior to any attempt in applying it to a non-flat surface. This can be performed by, for example, exposing the sheet to steam for about 15 to about 25 seconds.

Figure 3:
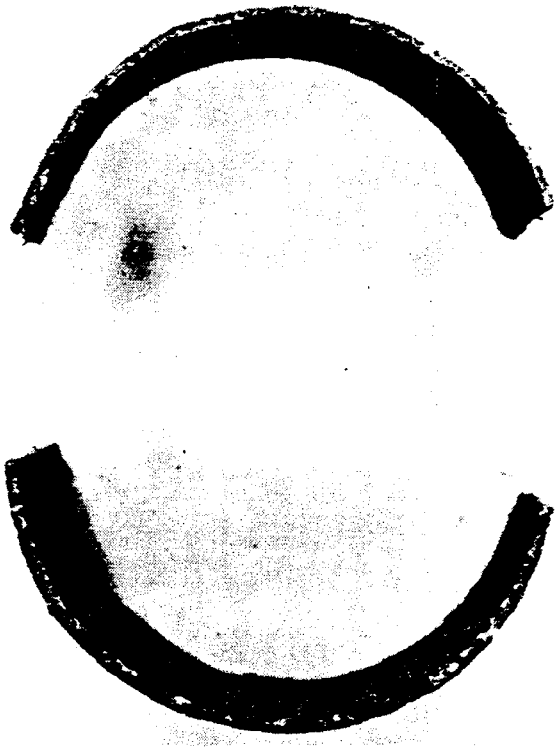
Figure 4:
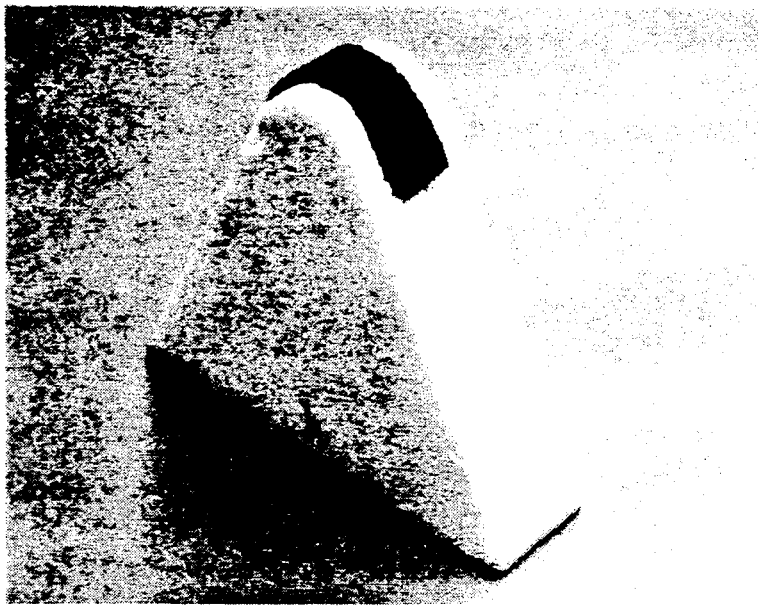

When these sheets are formable, they can be bent around a cylinder, as illustrated in FIG. 3. The formed sheets are then adhesively or otherwise attached onto the surface of the destructible pattern material in a manner which does not deleteriously interfere with the casting of the desired product. As illustrated within FIG. 4, the sheets may be adhesively applied to the destructible pattern utilizing an aqueous solution of PVA or other acceptable adhesive materials. The previously discussed aqueous PVA binder solution is preferred as the adhesive material.

Figure 5:
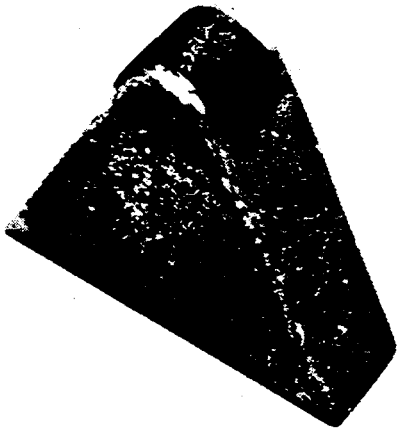
Figure 6:
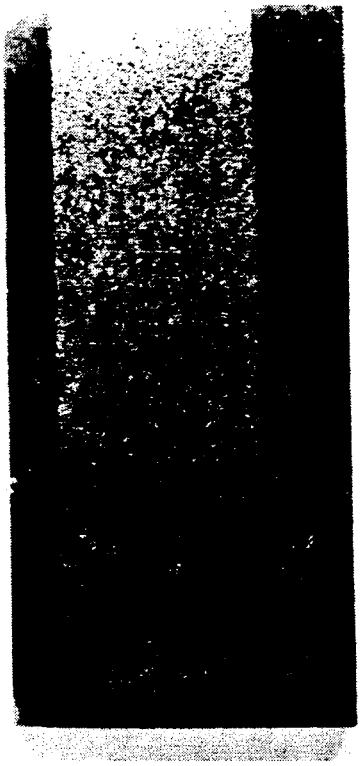

Castings from the resulting hard, wear-resistant particle containing destructible patterns are then made as described above. Examples of the casting according to the present invention are illustrated in FIGS. 5 and 6.

This method is particularly advantageously used in mass production techniques. For example, in employing the last described embodiment, the sheet manufacturing process (i.e., the formation of the sheet from the particles and binder) can occur at a location separate from the casting procedure. This is an important consideration in the efficient mass production of the product.

The method according to the present invention can be used to make iron products which have a wide variety of applications including the use in engine components such as cam shafts or cam followers, agricultural equipment, tillage tools, brakes, etc. Products made according to the present invention can be advantageously employed over their prior art counterparts due to the more effective bonding between the wear-resistant particle and the iron. In addition, the process according to the present invention can be employed without the use of non-aqueous slurries and safety hazards associated therewith.

In order to further illustrate the present invention and the advantages associated therewith, the following specific examples are given, it being understood that same are intended only as illustrative and in nowise limitative.

EXAMPLES

EXAMPLE 1

Methods for producing an iron product according to the present invention.

(A) A PMMA pattern with a carbide sheet attached thereto is formed by first mixing the carbide and PVA in a rectangular mold and spreading the mixture evenly. The excess binder is then removed using a suitable absorbent paper.

The sheet, along with the mold, is dried for 60 minutes in an oven held at 60° C. in order to partially set the binder. This allows the sheet to become strong enough for handling and cutting into pieces.

The partially set sheet is cut with a sharp edge into pieces such as those illustrated by FIG. 2 having a desired shape and size. These pieces are dried at 60° C. for additional 24 hours and subsequently bonded to the surface of the pattern using the PVA binder so as to produce a pattern such as that illustrated by FIG. 4.

A mold is then formed by a conventional method in the art, such as embedding the resultant pattern in a flask using either bonded or unbonded sand. See, the discussion on page 3 of Hansen et al. Bureau of Mines Report of Investigations 8942, 1985.

The desired metal, such as ductile iron, is poured, in liquid form, into the mold causing the pattern to vaporize, with the pattern gases exiting through the sand and the liquid metal filling the cavity vacated by the pattern.

The metal then solidifies forming an iron product having a wear resistant layer impregnated therein.

(B) A plurality of cavities having a depth of 0.5 mm are machined into a PMMA pattern at those positions where the wear resistant layer is to be located. A binder comprising a 10 wt. % solution of PVA in water is poured into the cavities.

Crushed carbide particles are then introduced into the cavities and allowed to settle. The excess binder is wiped off and the layer is dried in a hot air oven at a temperature of 60° C. for approximately 16 hours.

The dried pattern is then dipped into an aqueous ceramic slurry and shaken so as to remove the excess slurry. At this point, the pattern is immediately transferred to a hot air oven where it is dried at 50° C. for 16 hours.

A mold is then formed and the iron product cast in the same manner as example 1(A).

TABLE 1-continued

| Material | Mesh Size | Wettability |
|---|---|---|
| 12. Chrom. Carbide(5) | 60/120 | Wetted by D.I. |

1. Excellent wettability
2. Good wettability
3. Wettability less than that of Macrocrystalline WC
4. Wettability equal to that of Macrocrystalline WC
5. Excellent wettability; carbide tends to dissolve in cast iron Macrocrystalline, Kenface and KS-12 are trademarks of Kennametal, Inc., for tungsten carbide compositions.

These specimens according to the present invention, which are identified as S.N. 1–18, were then evaluated using dry sand and rubber wheel abrasion test.

In particular, these specimens were compared to the comparative examples, S.N. 19–21, which comprise 1020 steel, 1080 steel (quenched and tempered) and 1080 steel (quenched), respectively.

These test results are illustrated in Table 2.

TABLE 2

CALCULATION OF VOLUME LOSSES IN DRY SAND RUBBER WHEEL ABRASION TESTS: MATERIAL: CAST METAL COMPOSITES OF DUCTILE IRON WITH TUNGSTEN CARBIDE AND CHROMIUM CARBIDE

| S.N. | Reinforcement Material | Specimen No. | Initial Wt. gm | Final Wt. gm | Weight Loss gm | Density of gm/cm$^3$ | Volume Loss cm$^3$ | Average V Loss, cm$^3$ |
|---|---|---|---|---|---|---|---|---|
| 1 | MC | 1 | 99.4599 | 99.3885 | 0.0714 | 10.87 | 6.564 | 7.521 |
| 2 | MC | 2 | 93.1229 | 93.048 | 0.0749 | 10.87 | 6.886 | |
| 3 | MC | 3 | 100.3228 | 100.2237 | 0.0991 | 10.87 | 9.111 | |
| 4 | Cr3C2 | 1 | 85.7913 | 85.7356 | 0.0557 | 7.05 | 7.896 | 7.971 |
| 5 | Cr3C2 | 2 | 86.4831 | 86.4241 | 0.059 | 7.05 | 8.364 | |
| 6 | Cr3C2 | 3 | 81.7488 | 81.6948 | 0.054 | 7.05 | 7.655 | |
| 7 | GTE-WC, ang. | 1 | 101.7786 | 101.7226 | 0.056 | 11.95 | 4.686 | 5.648 |
| 8 | GTE-WC, ang. | 2 | 93.9399 | 93.8593 | 0.0806 | 11.95 | 6.744 | |
| 9 | GTE-WC, ang. | 3 | 89.5642 | 89.4983 | 0.0659 | 11.95 | 5.514 | |
| 10 | GTE-WC, spher. | 1 | 94.5713 | 94.5287 | 0.0426 | 12.77 | 3.335 | 2.834 |
| 11 | GTE-WC, spher. | 2 | 89.2265 | 89.2028 | 0.0237 | 12.77 | 1.855 | |
| 12 | GTE-WC, spher. | 3 | 92.6073 | 92.565 | 0.0423 | 12.77 | 3.312 | |
| 13 | Kenface | 1 | 95.413 | 95.2824 | 0.1304 | 7.54 | 17.294 | 20.587 |
| 14 | Kenface | 2 | 94.278 | 94.1113 | 0.167 | 7.54 | 22.148 | |
| 15 | Kenface | 3 | 93.545 | 93.3769 | 0.1683 | 7.54 | 22.320 | |
| 16 | KS-12 | 1 | 95.813 | 95.5581 | 0.2549 | 9.32 | 27.346 | 28.119 |
| 17 | KS-12 | 2 | 95.558 | 90.9325 | 0.2397 | 9.32 | 25.716 | |
| 18 | KS-12 | 3 | 93.321 | 93.0284 | 0.2917 | 9.32 | 31.294 | |
| 19 | Steel 1020 | 1 | 96.2164 | 95.45 | 0.7664 | 7.85 | 97.518 | 97.518 |
| 20 | Steel 1080 (Q&T) | 1 | | | | | | 33.57 |
| 21 | Steel 1080 (Q Only) | 1 | | | | | | 24.57 |

EXAMPLE 2

Testing of Actual Specimens made according to the present invention.

A group of specimens according to the present invention comprising ductile iron and a variety of hard materials were cast using a PMMA pattern. These specimens are described in Table 1.

TABLE 1

| Material | Mesh Size | Wettability |
|---|---|---|
| 1. GTE angular WC(1) | 40/80 | Wetted by D.I. |
| 2. GTE spherical WC(1) | 40/80 | Wetted by D.I. |
| 3. GTE spherical WC(1) | 100/200 | Wetted by D.I. |
| 4. Macrocryst., WC(2) | 40/80 | Wetted by D.I. |
| 5. Macrocryst., WC(2) | 100/140 | Wetted by D.I. |
| 6. Macrocryst., WC(2) | 140/200 | Wetted by D.I. |
| 7. Macrocryst., WC(2) | 200/325 | Wetted by D.I. |
| 8. Macrocryst., WC(2) | 325/15 micron | Wetted by D.I. |
| 9. Kenface, WC + 6w/0Co(3) | 40/80 | Wetted by D.I. |
| 10. KS-12, WC + 12w/0Co(4) | 100/140 | Wetted by D.I. |
| 11. KS-12, WC + 12w/0Co(4) | 140/200 | Wetted by D.I. |

From these results, it is seen that spheroidized WC has the highest wear resistance of all of the carbide types tested and it is an order of magnitude greater than that of quenched and tempered steel. Moreover, although spheroidized WC was the best, each of the specimens according to the present invention was also good.

While this invention has been described in terms of various preferred embodiments, the skilled artisan will appreciate the various modifications, substitutes, omissions, and changes which may be made without departing from the spirit thereof. Accordingly, it is intended that the scope of the present invention be limited solely by the scope of the following claims including equivalents thereof.

What is claimed is:

1. A method for impregnating an iron product with a hard wear-resistant material surface layer comprising (a) providing a destructible pattern of the desired iron product;

(b) applying a paste comprising a powder of the wear-resistant material and a binder comprising a solution of polyvinyl alcohol onto at least a portion of the surface of the said pattern;

(c) making a mold using the said pattern;

(d) casting an iron melt into said mold thereby forming an iron product having a wear-resistant material surface layer.

2. The method according to claim 1, further including coating the pattern with a ceramic slurry coating between (b) and (c).

3. The method of claim 2 wherein the ceramic slurry coating comprises an aqueous slurry.

4. The method according to claim 1 wherein said iron product comprises cast iron.

5. The method of claim 4 wherein the cast iron comprises ductile or gray iron.

6. The method of claim 1 wherein the wear-resistant material comprises spheroidal tungsten carbide, angularized tungsten carbide, chromium carbide, a eutectic mixture of WC and $W_2C$ or mixtures thereof.

7. The method of claim 6 wherein the wear-resistant material includes an additional alloying element.

8. The method of claim 7 wherein the additional alloying element comprises cobalt.

9. The method of claim 1 wherein the destructible pattern comprises EPS or PMMA.

10. The method of claim 1 wherein the binder comprises an aqueous solution of polyvinyl alcohol.

11. The method of claim 10 wherein the polyvinyl alcohol is present in the binder in amounts of greater than about 5% by weight.

12. The method of claim 10 wherein the destructible pattern comprises EPS or PMMA.

13. The method of claim 12 wherein the wear-resistant material comprises spheroidal tungsten carbide, angularized tungsten carbide, chromium carbide, a eutectic mixture of WC and $W_2C$ or mixtures thereof.

14. The method according to claim 13, further including coating the pattern with a ceramic slurry coating between (b) and (c).

15. The method of claim 14 wherein the ceramic slurry coating comprises an aqueous slurry.

16. The method of claim 15 wherein the iron comprises ductile or gray iron.

17. The method of claim 1 wherein the volume of the destructible pattern is chosen such that ratio of the casting volume to the area of the wear resistant layer to be impregnated therein is sufficient to provide a duration of the liquid metal/wear resistant material contact during casting which is effective to decrease spalling of the material.

18. A method of impregnating an iron product with a hard wear-resistant material surface layer comprising:

(a) providing a destructible pattern for a desired iron product;

(b) forming at least one groove or depression in the surface of the pattern;

(c) introducing a binder comprising an aqueous solution of polyvinyl alcohol into said at least one groove or depression;

(d) introducing a wear-resistant material into the said at least one groove or depression;

(e) making a mold using said pattern;

(f) casting an iron melt into said mold thereby forming an iron product having a hard wear-resistant material surface layer.

19. The method of claim 18 further comprising coating the surface of said pattern with a ceramic slurry coating between (d) and (e).

20. The method of claim 19 wherein the ceramic slurry coating comprises an aqueous slurry.

21. The method according to claim 18 wherein the at least one groove or depression has a depth of about 0.5 mm to about 3 mm.

22. The method according to claim 18 wherein said iron product comprises cast iron.

23. The method of claim 22 wherein the cast iron comprises ductile or gray iron.

24. The method of claim 18 wherein the wear-resistant material comprises spheroidized tungsten carbide, angularized tungsten carbide, chromium carbide, a eutectic mixture of WC and $W_2C$ or mixtures thereof.

25. The method of claim 24 wherein the wear-resistant material includes an additional alloying element.

26. The method of claim 25 wherein the additional alloying element comprises cobalt.

27. The method of claim 18 wherein the destructible pattern comprises EPS or PMMA.

28. The method of claim 18 wherein the polyvinyl alcohol is present in the binder in amounts of greater than about 5% by weight.

29. The method of claim 28 wherein the destructible pattern comprises EPS or PMMA.

30. The method of claim 29 wherein the wear-resistant material comprises spheroidized tungsten carbide, angularized tungsten carbide, chromium carbide, a eutectic mixture of WC and $W_2C$ or mixtures thereof.

31. The method of claim 30 further comprising coating the surface of said pattern with a ceramic slurry coating between (d) and (e).

32. The method of claim 31 wherein the ceramic slurry coating comprises an aqueous slurry.

33. The method of claim 32 wherein the iron comprises ductile or gray iron.

34. The method for impregnating an iron product with a hard wear-resistant material surface layer comprising:

(a) providing a destructible pattern of a desired iron product;

(b) preparing a formable sheet comprising the hard wear-resistant material and a binder which comprises an aqueous solution of polyvinyl alcohol;

(c) forming the formable sheet into a desired shape and size;

(d) attaching the formed sheet onto at least a portion of the destructible pattern;

(e) making a mold using the pattern;

(f) casting an iron melt into said mold thereby forming an iron product having a hard wear-resistant surface layer impregnated therein.

35. The method of claim 34 further comprising coating the surface of said pattern with a ceramic slurry coating between (d) and (e).

36. The method of claim 35 wherein the ceramic slurry coating comprises an aqueous slurry.

37. The method according to claim 34 wherein said iron product comprises cast iron.

38. The method of claim 37 wherein the cast iron comprises ductile or gray iron.

39. The method of claim 34 wherein the wear-resistant material comprises spheroidized tungsten carbide, angularized tungsten carbide, chromium carbide, a eutectic mixture of WC and $W_2C$ or mixtures thereof.

40. The method of claim 39 wherein the wear-resistant material includes an additional alloying element.

41. The method of claim 40 wherein the additional alloying element comprises cobalt.

42. The method of claim 34 wherein the destructible pattern comprises EPS or PMMA.

43. The method of claim 34 wherein the polyvinyl alcohol is present in the binder in amounts of greater than about 5% by weight.

44. The method of claim 43 wherein the destructible pattern comprises EPS or PMMA.

45. The method of claim 44 the wear-resistant material comprises spheroidized tungsten carbide, angularized tungsten carbide, chromium carbide, a eutectic mixture of WC and $W_2C$ or mixtures thereof.

46. The method of claim 45 comprising coating the surface of said pattern with a ceramic slurry coating between (d) and (e).

47. The method of claim 46 wherein the ceramic slurry coating comprises an aqueous slurry.

48. The method of claim 47 wherein the iron comprises ductile or grey iron.

49. The method according to claim 34 wherein the formable sheet is adhesively attached onto at least a portion of the destructible pattern in (d).

50. The method according to claim 49 wherein the adhesive comprises an aqueous solution of polyvinyl alcohol.

* * * * *